US005657032A

United States Patent [19]

Liechty et al.

[11] Patent Number: 5,657,032

[45] Date of Patent: Aug. 12, 1997

[54] AIRCRAFT CELLULAR COMMUNICATIONS ANTENNA

[75] Inventors: Robert Blaine Liechty; Jesse Carol Holloway, both of Greenville, Tex.

[73] Assignee: E-Systems, Inc., Dallas, Tex.

[21] Appl. No.: 518,794

[22] Filed: Aug. 24, 1995

[51] Int. Cl.[6] ..... H01Q 1/28; H01Q 13/10

[52] U.S. Cl. ..... 343/770; 343/850; 343/872; 343/705

[58] Field of Search ..... 343/770, 771, 343/767, 850, 872, 705, 853; H01Q 1/28, 13/10

[56] References Cited

U.S. PATENT DOCUMENTS

| | | | |
|---|---|---|---|
| 2,543,468 | 2/1951 | Riblet | 343/771 |
| 3,172,113 | 3/1965 | Heinard et al. | 343/771 |
| 4,325,141 | 4/1982 | Ghose | 343/705 |
| 4,392,139 | 7/1983 | Aoyama et al. | 343/705 |
| 4,749,997 | 6/1988 | Canonico | 343/872 |
| 4,922,259 | 5/1990 | Hall et al. | 343/700 MS |
| 5,049,891 | 9/1991 | Ettinger et al. | 343/705 |
| 5,148,183 | 9/1992 | Aldama | 343/853 |
| 5,298,907 | 3/1994 | Klein | 343/715 |
| 5,315,309 | 5/1994 | Rudow et al. | 343/705 |
| 5,323,170 | 6/1994 | Lang | 343/872 |
| 5,355,142 | 10/1994 | Marshall et al. | 343/700 MS |

FOREIGN PATENT DOCUMENTS

| | | | |
|---|---|---|---|
| 85532 | 7/1957 | Netherlands | 343/770 |
| 127708 | 4/1959 | U.S.S.R. | 343/771 |

*Primary Examiner*—Hoanganh T. Le
*Attorney, Agent, or Firm*—Harold E. Meier

[57] ABSTRACT

An elliptic-shaped cylindrical antenna radiating element having a first side and a second side includes a first rectangular slot disposed in the first side and a second port disposed in the second side. A microstrip feed network located within the antenna radiating element radiates and receives horizontal polarized electromagnetic signals through the first slot and the second slot at a phase difference of about 180 degrees. The antenna radiating element radiates and receives horizontal polarized electromagnetic signals substantially omnidirectionally.

14 Claims, 2 Drawing Sheets

AIRCRAFT CELLULAR COMMUNICATIONS ANTENNA

TECHNICAL FIELD

The present invention relates to a communications antenna and, in particular, to an aircraft communications antenna for receiving and transmitting horizontal polarized electromagnetic signals in cellular communications.

BACKGROUND OF THE INVENTION

In general, communication systems antennas emit and/or receive communication signals propagating through air and space. Numerous different types of communications antennas are in use today. Antennas transmit (and receive) electromagnetic waves made of a combination of electric and magnetic fields propagating in a certain direction. The electric and magnetic fields are perpendicular to each other and are perpendicular to the direction of propagation of the electromagnetic wave (EM wave).

The orientation of the electric and magnetic fields with respect to the surface of the earth determines whether the electromagnetic wave (the communication signal) is vertically or horizontally polarized. If the electric field is parallel to the earth, the EM wave is horizontally polarized. If the electric field is perpendicular to the earth, the EM wave is vertically polarized. The structure and orientation of an antenna dictates whether the antenna emits or receives vertically or horizontally polarized EM waves (some structures emit and/or receive circularly polarized EM waves, however circular polarization will not be discussed herein). Generally, both the transmit and receive antennas in a communications system must be of the same polarization for proper transmission and reception.

Antennas radiate and receive energy in many different directions, however, most antennas radiate or receive energy in a very specific geometric radiation pattern that is non-uniform over a 360 degree circle parallel to the earth's surface. Antennas exhibiting this characteristic are called directional antennas. Some antennas are constructed (or oriented) to radiate or receive energy in all directions parallel to the surface of the earth. These antennas are called omni-directional antennas.

For example, a half-wave dipole antenna has a radiation pattern in the shape of a doughnut. Most of the energy radiated from a half-wave dipole is radiated substantially from right angles to the length of the dipole. As such, almost no energy is radiated along the lines extending along the length of the dipole. A half-wave dipole mounted horizontally to the earth (horizontal polarization) is a directional antenna (i.e. minimal radiation in the directions along the length of the dipole). A half-wave dipole mounted vertically to the earth (vertical polarization), therefore, is an omni-directional antenna (i.e. equal amount of radiation in all directions parallel to the earth). In the transmission mode, a dipole antenna should be pointed broadside to the desired direction of transmission or, in the reception mode, pointed broadside to the point of transmission of the signal from a transmitter.

Standard ground mobile cellular communications systems (ground-to-ground) use vertically polarized signals in the 800–900 MHz range. In order to reuse the same RF spectrum as ground-to-ground cellular systems, aircraft cellular communications system (air-to-ground) use horizontally polarized signals to prevent interference with the vertically polarized ground mobile cellular communication systems. While RF power management control techniques may help reduce some of this interference, a substantial amount of interference is still present. As such, the design of the aircraft antenna (coupled with the attributes of the operating environment, i.e., air-to-ground communication from a moving aircraft) plays a critical role in the performance of the aircraft cellular communications system. It must provide a high rejection of the vertically polarized ground communications signals.

One type of antenna that may be used in an aircraft cellular communications system is a stacked horizontal dipole antenna. It provides near omni-directional patterns with horizontal polarization. This type of antenna is usually oriented lengthwise along the centerline of the aircraft, and for that reason, an undesirable null in the antenna pattern exists along the axis of the antenna, fore and aft of the aircraft. Loss of the communication link is possible if the aircraft is turning or maintains an inbound/outbound flight profile with the ground station. Further, radiation of a vertical polarized component also increases for increasing angles off antenna boresight and the amount of horizontal component to vertical component suppression degrades overall performance. Consequently, use of a stacked horizontal dipole antenna results in a high potential for interference and/or loss of communications.

Accordingly, there exists a need for an antenna for use with aircraft cellular communication systems that transmits and receives horizontally polarized signals and provides high rejection of the vertically polarized ground mobile cellular communications signals. Further, the antenna should be capable of minimizing any potential for interference with ground mobile and fixed cell sites and reducing susceptibility to interference from sites that transmit vertical polarized signals. Also needed is an antenna that provides a deep null in the radiation pattern to prevent interference from ground mobile and fixed cell sites positioned substantially directly below the aircraft in flight. Additionally, there is needed an omni-directional antenna to provide maximum radiation outward to the horizon so that the communications link is independent of aircraft flight profile and ground station location.

SUMMARY OF THE INVENTION

According to the present invention, there is provided an antenna radiating element including an elliptic-shaped cylinder having a first port disposed in a first side and a second port disposed in a second side. A microstrip feed network located within the radiating element radiates and receives horizontal polarized electromagnetic signals through the first port and the second port whereby the antenna radiating element radiates and receives electromagnetic signals substantially omnidirectionally.

In accordance with the present invention, there is provided an antenna system including an antenna radiating element and a radome mounted on the underside of an aircraft. The antenna radiating element has an elliptic, cylindrical shape including a first slot disposed in a first side for passing electromagnetic signals and a second slot disposed in a second side for passing electromagnetic signals. A feed network transmits and receives horizontal polarized electromagnetic signals through the first slot and the second slot whereby the antenna radiating element radiates and receives electromagnetic signals substantially omnidirectionally. The radome substantially surrounds or encompasses the antenna radiating element.

DESCRIPTION OF THE DRAWINGS

For a more complete understanding of the present invention and the advantages thereof, reference is made to the following detailed description taken in conjunction with the accompanying drawings wherein.

DETAILED DESCRIPTION

Figure 1:
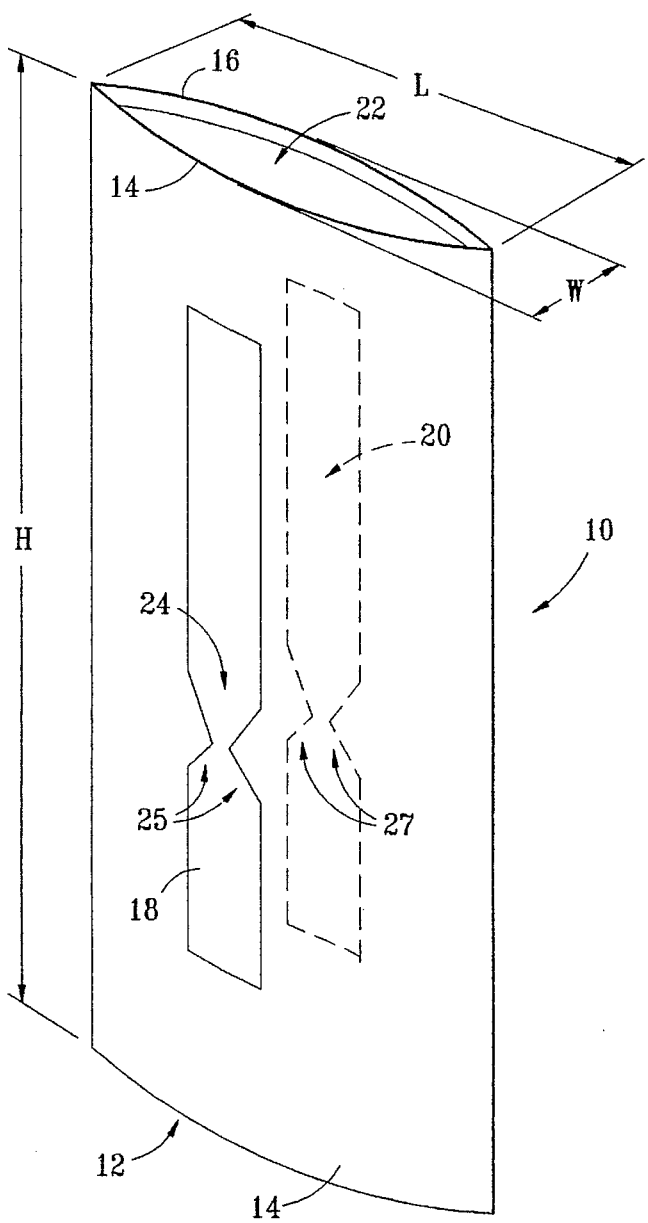
FIG. 1 is an elevated view illustrating an antenna radiating element in accordance with the present invention.

With reference to the drawings, like reference characters designate like or similar parts throughout the drawings.

Referring now to FIG. 1, there is shown an elevated view of an antenna radiating element 10 of the present invention. The antenna radiating element 10 includes an elliptic-shaped cylinder 12 having a first side 14 and a second side 16. While the cylinder may include many cylindrical shapes, in the preferred embodiment the cylinder 12 is elliptic-shaped. The first side 14 and the second side 16 have curved surfaces and are connected to form the elliptical cylinder 12 defining a radiation cavity 22. As will be appreciated, the first side 14 and the second side 16 may be manufactured or connected integrally to form the cylinder 12.

In the preferred embodiment, the height H of the antenna radiating element is approximately ten (10) inches, the length L is approximately four and one-quarter (4¼) inches, and the width W is approximately one (1) inch.

The first side 14 has a first port 18 for receiving RF signals into the radiation cavity 22 and for transmitting RF signals from the radiation cavity 22. The second side 16 includes a second port 20 (shown in dotted lines) similar to the port 18. The ports (or apertures) 18, 20 are oriented substantially vertically along the first side 14 and the second side 16, respectively. In the preferred embodiment, the ports 18, 20 are in the shape of rectangular slots with a length of approximately 8¾ inches and a width of approximately ½ inch. The longitudinal axis of each port 18, 20 is substantially parallel to the longitudinal axis of the elliptic-shaped cylinder. The configuration of the ports 18, 20 in the cylinder 12 substantially rejects and/or suppresses vertically polarized electromagnetic signals.

Disposed within the radiation cavity 22 is a microstrip feed network 24. The microstrip feed network 24 is connected or coupled to the port 18 by connection to two feed tabs 25. Similarly, the microstrip feed network 24 is connected or coupled to the port 20 by connection to two feeds tabs 27. The feed tabs 25, 27 are formed as part of the ports 18, 20, respectively. As will be appreciated, the microstrip feed network is constructed on a small circuit card assembly that is placed between the ports 18 and 20 within the radiation cavity 22. The feed tabs 25, 27 are each then connected preferably by soldering, to a point on the microstrip feed network 24 to provide a feed path to the ports 18, 20. The microstrip feed network 24 transmits and/or receives RF signals through the ports 18, 20.

In the preferred embodiment, the microstrip feed network includes a first feed point for transmitting and/or receiving RF signals through the first port 18 and a second feed point for transmitting and/or receiving RF signals through the second port 20. The first feed point and the second feed point are positioned on the microstrip network 24 such that the RF signal transmitted and/or received from the first feed point is substantially 180 degrees out of phase with the RF signal transmitted and/or received from the second feed point. In the preferred embodiment, the RF signals transmitted and received are in the range of 800–900 MHz.

As will be appreciated, the microstrip feed network 24 radiates or emits two orthogonal electromagnetic signals substantially 180 degrees out of phase with each other from the first port and the second port. It will be understood, the microstrip feed network 24 generally receives electromagnetic signals through the first port 18 and also receives electromagnetic signals through the second port 20. The feed points are positioned within the microstrip feed network such that the RF signals received through one of the ports 18, 20 is shifted substantially 180 degrees out of phase. As such, the RF signals received are then combined to produce the received RF signal that is coupled a receiver (not shown) in a conventional communication system.

Figure 2:
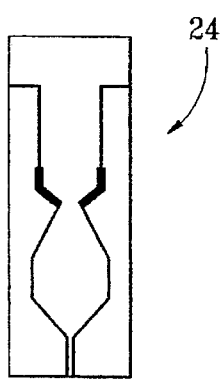
FIG. 2 illustrates a microstrip feed network used with the present invention.

Now referring to FIG. 2, there is illustrated the microstrip feed network 24 in accordance with the present invention. The microstrip feed network 24 is positioned within the radiation cavity 22 of the antenna radiation element 10 and emits (or radiates) and receives RF signals. The microstrip feed network 24 provides a signal path to a receiver (not shown) and from a transmitter (not shown) in an aircraft cellular conventional communication system. As will be appreciated, any radiation or reception source may be used within the radiation cavity 22 to obtain the desired results, such as stripline feed network, coax feed network, and the like. In the preferred embodiment, the network 24 is a microstrip feed network.

The geometry and structure of the antenna radiating element 10 and the ports 18, 20 provide an antenna that transmits and receives horizontally polarized RF signals and rejects vertically polarized RF signals. The antenna radiating element 10 provides a greater than 20 dB nominal suppression of vertically polarized signals. The curved nature of the ports 18, 20 within the curved first side 14 and the curved second side 16 provide omni-directional transmission and reception of RF signals. As such, the antenna radiating element allows the aircraft to attain almost any relatively horizontal flight profile without affecting the communications link between the aircraft and a ground station. An aircraft having such an antenna can make turns and/or maintain an inbound/outbound flight profile with respect to the location of the ground station without loss or potential loss of the communications link.

Figure 3:
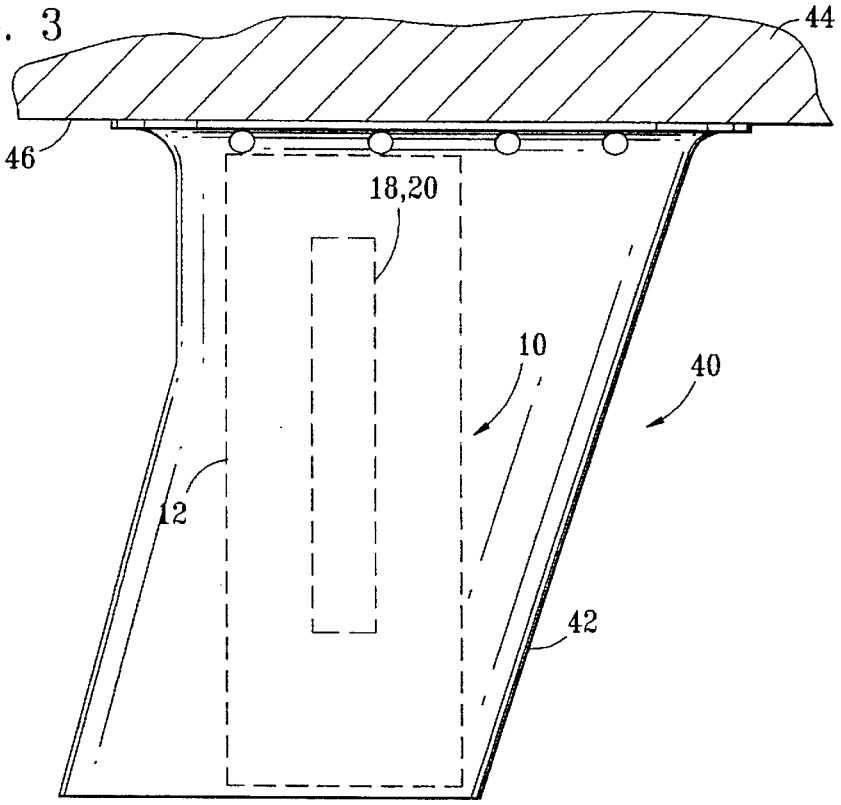
FIG. 3 is a side view illustrating an antenna system including the antenna radiating element of FIG. 1 within a radome.

Referring now to FIG. 3, there is illustrated a side view of an antenna system 40 in accordance with the present invention. The antenna system 40 includes the antenna radiating element 10 having an elliptic-shaped cylinder 12 and ports or slots 18, 20, all shown in dotted lines. The antenna system 40 further include a radome 42 that substantially encompasses or surrounds the antenna radiating element 10.

The antenna radiating element 10 and the radome 42 are mounted or connected to an aircraft 44 having an underside 46. It will be understood that the mounting or connection means is of a type normally used in the industry. In FIG. 3, only a fragmentary portion of the aircraft 44 is shown. The antenna radiating element 10 and the radome 42 are shown mounted or connected to the underside 46 of the aircraft 44 and extending vertically away from the underside 46. The placement and orientation (extending vertically from the underside 46 of the aircraft 44) of the antenna radiating element 10 provides a null in the antenna pattern at points that are substantially directly below the aircraft 44.

Figure 4:
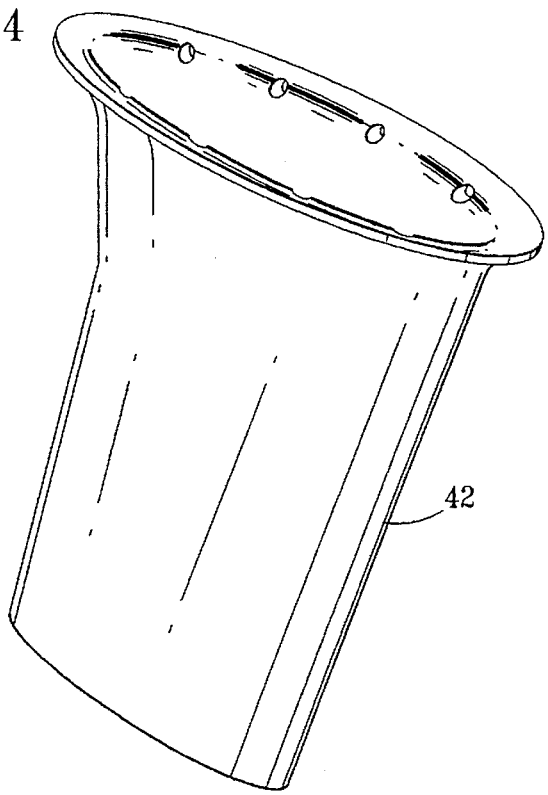
FIG. 4 is an elevated view illustrating the radome shown in FIG. 3.

Now referring to FIG. 4, there is shown an elevated view of the radome 42 used in accordance with the present invention. The radome 42 is shaped for aerodynamic purposes and encompasses or surrounds the antenna radiating element 10 for protection against the environment. The radome 42 comprises material that allows electromagnetic waves to pass through the radome 42 for transmission and reception at the antenna radiating element 10. As shown in FIG. 4, the radome 42 is blade-shaped. It will be understood, however, that the radome 42 may have numerous shapes for both aerodynamics and protection of the antenna radiating element 10.

Although a preferred embodiment of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention.

We claim:

1. An aircraft omnidirectional radiating element emitting and receiving substantially horizontal polarized energy, comprising:

an elliptic-shaped cylinder having a first curved side and a second curved side, the radius of curvature of the first side and the second side oriented orthogonal to a longitudinal axis of the cylinder;

an elongated first port formed in the first curved side and having a longitudinal axis oriented in the direction of the longitudinal axis of the cylinder;

an elongated second port formed in the second curved side and having a longitudinal axis oriented in the direction of the longitudinal axis of the cylinder;

a first feed tab formed as a part of the elongated first port along the longitudinal axis thereof;

a second feed tab formed as a part of the elongated second port along the longitudinal axis thereof; and a microstrip antenna feed network mounted within the cylinder and coupled to the first feed tab and the second feed tab for radiating and receiving horizontally polarized electromagnetic signals through the first port and the second port such that the antenna radiating element radiates and receives electromagnetic signals substantially omnidirectionally.

2. An antenna radiating element in accordance with claim 1 wherein the first port has a rectangular shape and the second port has a rectangular shape.

3. An antenna radiating element in accordance with claim 1 wherein the first port comprises a rectangular slot and the second port comprises a rectangular slot, the longitudinal axis of each slot substantially parallel to the longitudinal axis of the elliptic-shaped cylinder.

4. An antenna in accordance with claim 1 wherein the microstrip antenna feed network further includes an energy radiator for radiating a first electromagnetic signal for transmission through the first port and radiating a second electromagnetic signal for transmission through the second port, with said first electromagnetic signal substantially 180 degrees out of phase with said second electromagnetic signal.

5. An antenna in accordance with claim 1 wherein the microstrip antenna feed network emits two orthogonal electromagnetic signals substantially 180 degrees out of phase with each other, the electromagnetic signals emitted from the first port and the second port, respectively.

6. An antenna radiating element comprising:

a first portion having a curved surface and having a first aperture including a pair of first feed tabs within said first portion;

a second portion having a curved surface and having a second aperture including a pair of second feed tabs within said second portion, said second portion connected to the first portion to produce a shaped cylinder wherein the first portion and said second portion define a radiation cavity; and a microstrip antenna feed network mounted within the radiation cavity and coupled to the first feed tabs and the second feed tabs for transmitting and receiving horizontally polarized signals through the first aperture and the second aperture.

7. An antenna radiating element in accordance with claim 6 wherein the first aperture has a rectangular shape and the second aperture has a rectangular shape.

8. An antenna radiating element in accordance with claim 6 wherein the first aperture and the second aperture comprise elongated slots each having a longitudinal axis substantially parallel with the longitudinal axis of the shaped cylinder.

9. An antenna radiating element in accordance with claim 6 wherein the microstrip antenna feed network further includes an energy radiator for radiating a first electromagnetic signal for transmission through the first aperture and radiating a second electromagnetic signal for transmission through the second aperture, with said first electromagnetic signal substantially 180 degrees out of phase with said second electromagnetic signal.

10. An antenna for transmitting and receiving horizontal polarized signals and substantially rejecting vertical polarized signals comprising:

an elliptic-shaped cylinder comprising, a first curved surface having a first slot oriented substantially along a longitudinal axis of the cylinder, and a second curved surface having a second slot oriented substantially along the longitudinal axis, the second curved surface connected to the first curved surface, the first curved surface and said second curved surface defining a cavity; and a microstrip antenna feed network positioned within the cavity for transmitting and receiving through the first slot and the second slot a horizontal polarized signal.

11. An antenna in accordance with claim 10 wherein the signal transmitted from the microstrip antenna feed network through the second slot is substantially 180 degrees out of phase with the signal transmitted through the first slot.

12. An antenna system for use with an aircraft for communicating between the aircraft and a ground station, the antenna system comprising:

a cylindrical antenna radiating element having a curved first side and a curved second side, the radius of curvature of the first side and the second side oriented orthogonal to a longitudinal axis of the cylinder comprising, an elongated first port having a first feed tab and disposed in the first side of the cylinder for passing electromagnetic signals the first port having a longitudinal axis oriented in the direction of the longitudinal axis of the cylinder, and an elongated second port having a second feed tab and disposed in the second side of the cylinder for passing electromagnetic signals the second port having a longitudinal axis oriented in the direction of the longitudinal axis of the cylinder;

a microstrip antenna feed network coupled to the first feed tab and the second feed tab for radiating and receiving horizontally polarized electromagnetic signals through the first port and the second port whereby the antenna radiating element radiates and receives electromagnetic signals substantially omnidirectionally; and a radome substantially surrounding the antenna radiating element.

13. An antenna system in accordance with claim 12 wherein the radome is substantially cylindrically shaped.

14. An antenna system in accordance with claim 12 wherein the first port of the antenna radiating element emits a first signal and the second port emits a second signal that is 180 degrees out of phase with the first signal.

* * * * *